US005094455A

United States Patent [19]

Persuy

[11] Patent Number: 5,094,455

[45] Date of Patent: Mar. 10, 1992

[54] DEVICE TO QUICKLY FORM A HAND OF A PREDETERMINED DEAL OF PLAYING CARDS

[75] Inventor: Michel Persuy, Le Vesinet, France

[73] Assignee: Acticiel S.A., France

[21] Appl. No.: 708,560

[22] Filed: May 31, 1991

[30] Foreign Application Priority Data

May 31, 1990 [FR] France ..... 90 06790
Jun. 21, 1990 [FR] France ..... 90 07775

[51] Int. Cl.[5] ..... A63F 1/10
[52] U.S. Cl. ..... 273/150; 273/148 A
[58] Field of Search ..... 273/150, 151, 148 A

[56] References Cited

U.S. PATENT DOCUMENTS 2,785,901 3/1957 McLemore ..... 273/150
3,550,944 12/1970 Chamberlin ..... 273/148 A
4,073,494 2/1978 McAdams ..... 273/150
4,790,540 12/1988 Lim et al. ..... 273/150

*Primary Examiner*—Benjamin Layno
*Attorney, Agent, or Firm*—William A. Drucker

[57] ABSTRACT

The device consists of a hollow tubular body which has, at one side at its upper portion, four parallel slots intended to each receive a pack of thirteen cards in one of the colours of a deck of cards. A vertical screen disposed at the rear of the slots prevents the packets of cards being seen by the other players. The other portion of the body houses a wound tape on which a list of the player's successive hands is printed. This list comes out through a slot towards the bottom of the body and then enters inside the latter through a slot and comes out through a slot. The player reads on the portion of the tape coming out through the slot 9 the disposition of the hand to be played and quickly forms this hand by means of the packs of cards housed inside the slots. The device enables a player at a table to quickly form a predetermined bridge hand.

12 Claims, 2 Drawing Sheets

FIG. 1
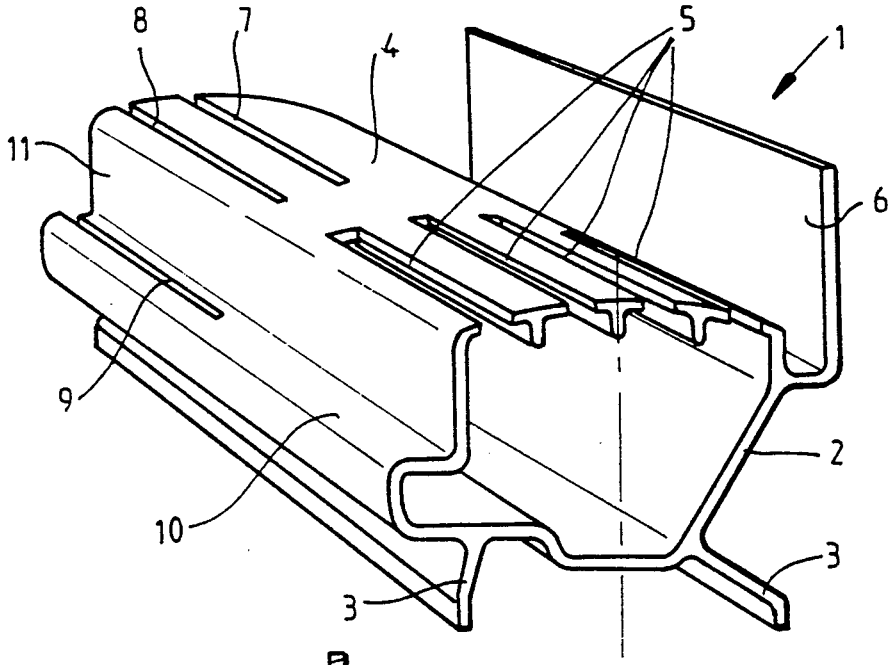
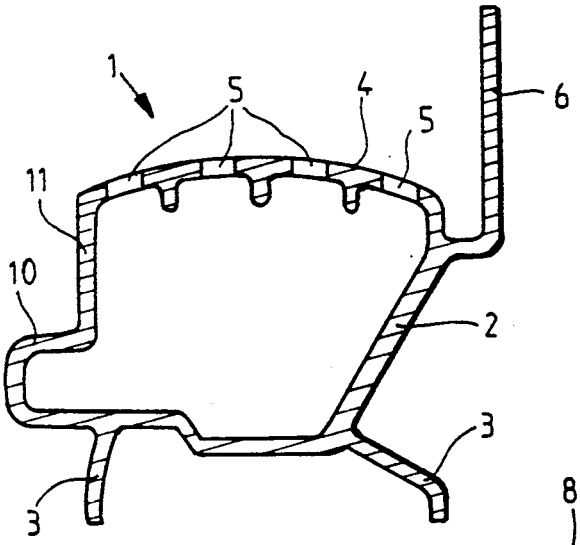
FIG. 2
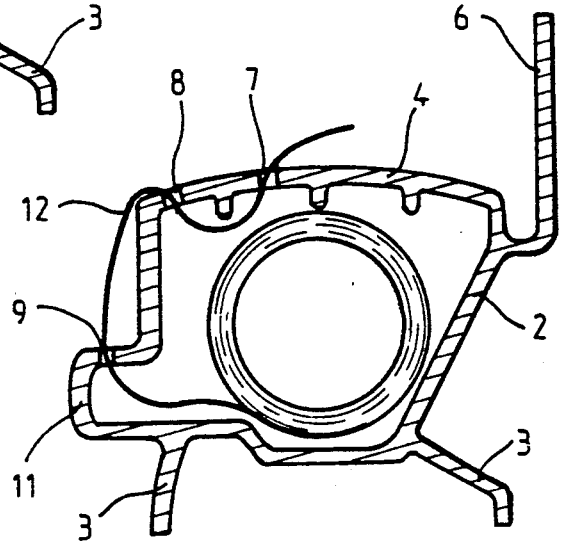
FIG. 3

DEVICE TO QUICKLY FORM A HAND OF A PREDETERMINED DEAL OF PLAYING CARDS

FIELD OF THE INVENTION

The invention concerns a device making it possible to form predetermined deals of playing cards.

BACKGROUND OF THE INVENTION

A method is known of how to prepare for example a deal of a game of bridge by using a case, a deck of cards and a printed list of deals. This may be carried out by a non-player before the deal is effectively played, but this requires a specific device and a certain amount of time.

Another embodiment would consist of giving each player a deck of cards and a list of his deals to form his hand at the table. However, without any aid, the ways and means to carry out this operation at the table would be difficult, having regard to the need for absolute secrecy with respect to the other players.

SUMMARY OF THE INVENTION

The object of the present invention is to overcome these drawbacks and, to this effect, proposes an extremely simple and cheap device enabling each player, at the table and before the deal is played, to quickly and secretly form with respect to the other players, the hand he is about to play and whose configuration is provided by the current ordinary devices, such as microcomputers or telecommunications services.

The device of the invention made available to each player includes on a given support a housing intended to receive a list of hands per player and printed on a tape, a device allowing for the secret manual winding of this list controlled by the player, and separate support means making is possible to lay out four packs of cards to be played, each pack containing thirteen cards of the same colour and disposed in such a way that the marking of each colour is clearly visible and that the manual extraction one by one of the packs of cards is simplified. Thus, the player, after having carried out the necessary unwinding of the list of deals so as to know the configuration of the next hand to be played, would only have the successively take, from the four packs each corresponding to one colour, the cards mentioned on the list so as to form colour after colour the hand of the next deal to be played.

Advantageously, the device could have the shape of a tube with a horizontal axis, one portion of the length of this device being used to support the four packs of cards, whereas the other part is intended to receive the list of hands and allows it to be run off discretely in front of the player.

The means for holding the four packs of cards are equipped with four successive slots inserted in one portion of the tube and oriented along the generating lines of the latter, each slot receiving a pack of cards which abuts on the internal surface of the tube. Advantageously, this tube portion extends towards the top over the entire length of the slots by a vertical wing isolating these slots and the packs of cards they contain from being seen by the other players.

The means for storing and unwinding the list of hands are constituted by the other portion of the tube which receives the wound-up list and has at least one slot diposed towards the front and from which comes out the external end of the list to be read by the player. Advantageously, two other slots close to each other and through which the list of hands passes successively are disposed at the rear of the outlet slot so as to create a chicane effect and stop unwinding of the list of hands. The outlet slot may be fitted in front with the face of a vertical tube, which makes it possible to hide from the sight of the other players the portion of the list of hands coming out of the device, thus providing absolute secrecy.

According to one variant, the tubular body receiving the four packs of cards and the list of hands per player is made integral with a support back with a general vertical orientation and taken along a perpendicular axis of the tubular body and intended to be applied against the section or vertical edge of the bridge table and provided with means for fixing it to said table. Advantageously, the upper vertical plane portion of the support back used for fixing it to the table extending by a second portion, also vertical or roughly vertical, integral with the tubular body whose plane is slightly offset towards the inside to the bridge table under the plate of the table.

Thus, the tubular body of the device is fully hidden from being seen by the other players by virtue of the edge of the bridge table, which further improves secrecy. Moreover, the base of the bridge table is then totally freed.

BRIEF DESCRIPTION OF THE DRAWINGS

To more readily understand the device of the invention, there now follows a non-restrictive example of a preferred embodiment and variants with reference to the accompanying diagrammatic drawing on which:

FIG. 1 is a perspective view of a device conforming to the invention for quickly forming a bridge hand, FIG. 2 is a vertical cutaway view of the device of FIG. 1, shown on the side of the portion supporting the pack of cards sorted by colours, FIG. 3 is a vertical cross section of the other extremity of the device of FIG. 1 and forming the portion of the device storing the list of hands.

DETAILED DESCRIPTION OF THE PREFERRED EMBODIMENTS

Figure 4:
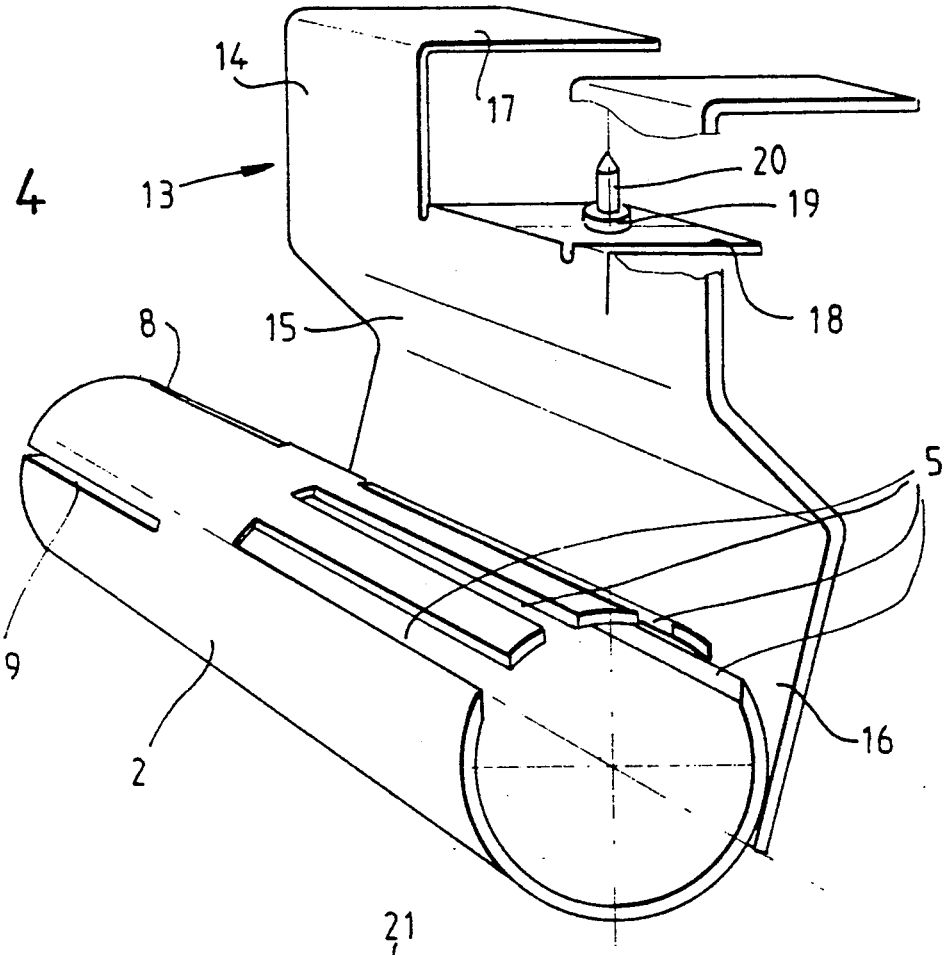
FIG. 4 is a perspective view of one variant of the device of the invention intended to be fixed on the edge of the top of the bridge table.

FIGS. 1 to 3 generally show at 1 the device of the invention and which comprises a tubular body 2 constituted by an extruded aluminium profile or section and having at its lower portion feet 3 which keep it in position on a horizontal support. In the upper face 4 roughly horizontal from the tubular body 2 and on the right portion of said body shown on FIG. 1, four successive slots 5 are provided parallel to the longitudinal axis of the body 2, each slot being slightly longer than the width of one playing card. Each slot 5 is intended to receive a pack of thirteen cards of the same colour of a deck of cards and its width is accordingly provided.

Towards the rear, at least along a length corresponding to that of the slots 5, the body 2 extends by a vertical wing 6 sufficiently high to hide from being seen by the other players at the table the number of remaining cards in each colour and housed in the slots 5.

On its left portion of said body as shown on FIG. 1, the tubular body comprises, fitted in its upper face 4, two longitudinal slots 7, 8 close to each other, whereas, towards the front, a third slot 9 parallel to the slots 7, 8 is fitted in a horizontal portion 10 having the lowest height of the body 2 which extends to one vertical portion of said body.

FIG. 3 diagrammatically shows a wound-up sheet 12 on which a list of the player's successive hands is printed drawn up, for example, from a microcomputer or a telematics device (such as the one designated under the "MINITEL" brand). The external end of the list 12 comes out the body 2 through the slot 9, enters through the slot 8 and comes out through the slot 7 at a location clearly seen by the active player but hidden from the other players by the vertical portion 11 of the body 2. A traction operated by the active player on the end of the list 12 coming out through the slot 7 unwinds the list 12, thus enabling the active player to take cognizance of the next hand to be prepared, whereas the slots 7 and 8 produce a chicane effect stopping the unwinding of said list.

There now follows a description concerning the use of the device. The player has available, inside the device, the list of the successive hands he has to play, the end of said list coming out of the device through the lower slot 9 so as to be clearly legible by the active player. The packs (not shown) of thirteen cards of each of the four colours of a deck of cards are respectively disposed inside the four successive slots of the device 5.

The player then merely needs to apply slight traction on the end of the list 12 coming out of the slot 7 for the player to see the indications relating to the configuration of his hand in the next deal to be played, the unwinding of the list 12 being however appropriately stopped by the chicane effect due to the successive slots 8 and 7. The vertical face 11 prevents the other players from knowing the information displayed on the list 12, thus providing absolute secrecy.

By successively using the four packs of cards contained in the slots 5, the player no longer has to merely set up his hand colour by colour according to the indications of the list 12, which can be easily and quickly carried out without any risk of errors occuring. Thus, the player may form his hand within 40 to 50 seconds on average. The vertical wing 6 stops the other players from seeing the thickness of the packs of cards remaining in each slot and likely to give some indications as to distribution of deck.

The shape of the section forming the body 2 is designed so that, with a suitable set of cutters, the slots 5 and the slots 7, 8 and 9 may be respectively embodied in one operation. A conical inlet, embodied by a third set of cutters, may allow the cards to be easily introduced into the slots 5.

Advantageously, the roll of deals 12 may be obtained by cutting into four strips (one after each of the four hands) an A4 format sheet coming out of the printer. Each strip shall therefore be about 52 mm long and the portion of the body 2 required to contain this strip shall thus have the same length as the strip. This cutting could be easily carried out by cutting three times with a pair scissors.

FIG. 4 shows at 2 the tubular body of a variant of the device of FIG. 1 and at 5 the four parallel slots fitted in the upper portion of said body so as to receive the pack of thirteen cards of each of the four colours of a deck of cards. The outlet slot 9 for the list of hands, as well as the slot 8 using for stopping unroling of this list, are shown on the other side of the body 2.

The figure shows at 13 a support back whose vertical plane upper portion 14 extends by a slanting portion 15 oriented in the direction opposite the tubular body 2, then by a roughly vertical portion 16 whose lower end is integral with the body 2 along a generating line of the latter. At is upper end, the vertical portion 14 is extended by a horizontal wing 17 which extends in the direction opposite the tubular body 2. With a certain distance with respect to the wing 17 and parallel to the latter, a plate 18 extends and is integral with the portion 14 of the back 13. The plate 18 comprises a threaded hole 19 with a vertical axis into which a seal screw 20 is engaged whose point is directed towards the wing 17.

So as to secure the device to the bridge table, the player presses the upper portion 14 of the back 13 against the vertical edge of the table facing him by pressing the horizontal wing 7 against the upper face of the table plate. He then actuates the screw 20 until the latter engages the lower face of the table plate by pressing the latter against the wing 17. The body 2 of the device is thus slightly positioned under the plate of the table and is completely hidden from the other players by virtue of the edge of the table.

Figure 5:
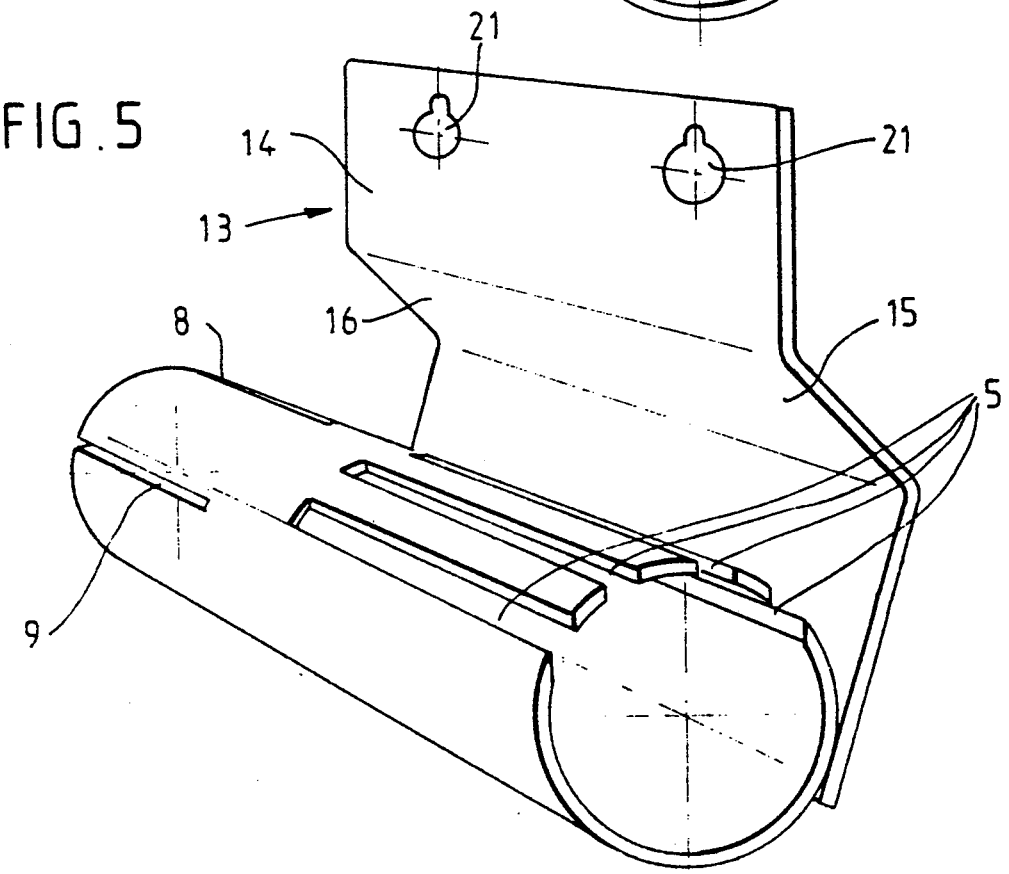
FIG. 5 is a perspective view of another variant of the device of FIG. 1.

According to the variant shown on FIG. 5, the upper vertical portion 14 of the back 13 comprises holes with a horizontal axis and used for fixing, by means of a screw (not shown), said part 14 to the vertical edge of the plate of the bridge table.

The above description is given simply as a non restrictive example, constructive additions modifications being able to be made without departing from the context of the invention.

What is claimed is:

1. Device making it possible to quickly form at a bridge table a hand from a predetermined deal of playing and comprising on a given support a housing for receiving a list of hands per player, and separate support means allowing for the laying out of four packs of playing cards each pack containing thirteen cards of one colour, wherein said device comprises a body with a first tubular portion in which four slots are provided orientated along generating lines, which constitute said means for supporting the packs of cards, and a second tubular portions which is capable of internally receiving a wound-up tape having a list of hands printed thereon, wherein the external end of which is capable of passing through said second portion of the body through an outlet slot in said second portion for viewing by a player.

2. Device according to claim 1, wherein said outlet slot of the list of hands is provided towards the front of the body of the device.

3. Device according to claim 1, wherein said second tubular portion further having two other slots parallel to said outlet slot and through which the list of hand successively passes so as to produce a chicane effect and prevents the list advancing through the outlet slot.

4. Device according to claim 1, wherein said second tubular portion of the body, inside which a list of hands is stored, has at the back of the outlet slot a vertical face used to hide from being seen by the other players the portion of the list of hand outside the device.

5. Device according to claim 1, wherein the portion of the body internally receiving the list of hands is long enough to allow for the storage of a wound-up paper tape corresponding to one quarter of an A4 format sheet.

6. Device according to claim 1, wherein said device is formed by a single tubular element equipped with feet at its lower end, and which has on one portion of its length the slots receiving the four packs of cards per color and, on the other portion of its length, the slots for distributing the list of hands.

7. Device according to claim 1, wherein said device has towards the back, at least on one length corresponding to that of the means for supporting the cards, a vertical wing extending upwards.

8. Device according to claim 1, wherein said device comprises a support back whose at least the upper part is oriented vertically and whose lower end is integral with the body of the device, said upper portion of the support back comprising means for laying it flat against the vertical edge of the plate of the bridge table.

9. Device according to claim 8, wherein the lower portion of the support back integral with the body of the device is orientated approximately vertically whilst being offset by several centimeters in the direction opposing the body so that the device is hidden from being seen by the other players by means of the edge of the table.

10. Device acccording to claim 9, wherein the upper and lower portions of the support back are connected together by an intermediate portion slanted in the direction opposite the body.

11. Device according to claim 8, wherein the means for securing the support back to the bridge table include two horizontal plates integral with the upper portion of the back at different levels, the lower plate comprising a screw device to screw down the table plate against the upper plate.

12. Device according to claim 8, wherein the support back fixing means include at least one opening with a horizontal axis provided in the upper portion of the back so as to allow for the passage of a screw to be fixed in the vertical edge of the plate of the table.

* * * * *.